US005488270A

United States Patent [19]

Takita et al.

[11] Patent Number: 5,488,270

[45] Date of Patent: Jan. 30, 1996

[54] COLOR CRT DISPLAY APPARATUS

[75] Inventors: Hidenori Takita; Tatsuhiro Hirakawa, both of Nagasaki, Japan

[73] Assignee: Mitsubishi Denki Kabushiki Kaisha, Tokyo, Japan

[21] Appl. No.: 230,550

[22] Filed: Apr. 20, 1994

[30] Foreign Application Priority Data

Dec. 10, 1993 [JP] Japan ..... 5-310887

[51] Int. Cl.[6] ..... H01J 29/56

[52] U.S. Cl. ..... 315/370; 315/8

[58] Field of Search ..... 315/370, 8, 85; 361/150; 335/213; 313/413

[56] References Cited

U.S. PATENT DOCUMENTS

| | | | |
|---|---|---|---|
| 4,882,521 | 11/1989 | Arimoto | 335/213 |
| 4,899,082 | 2/1990 | Sands et al. | 315/370 |
| 4,992,697 | 2/1991 | Penninga et al. | 313/440 |
| 4,996,461 | 2/1991 | Bentley | 315/370 |
| 5,049,847 | 9/1991 | Okuyama et al. | 335/214 |
| 5,066,891 | 11/1991 | Harrold et al. | 315/8 |
| 5,168,195 | 12/1992 | Breidigan et al. | 315/8 |
| 5,170,094 | 12/1992 | Giannantonio et al. | 313/431 |
| 5,189,348 | 2/1993 | Yokota et al. | 315/399 |

FOREIGN PATENT DOCUMENTS 50-28288 9/1975 Japan .

*Primary Examiner*—Theodore M. Blum

*Attorney, Agent, or Firm*—Burns, Doane, Swecker & Mathis

[57] ABSTRACT

A color CRT display apparatus in which the polarity and the strength of the external magnetic field in the tube direction of a CRT are detected by a magnet detecting element, and a current corresponding to the strength of the external magnetic field is supplied to a compensating coil which is wound around a funnel portion between a display panel and a deflection yoke and at a place where a purity rotation and a raster rotation by said external magnetic field in said tube direction are simultaneously compensated, thereby both the purity rotation and the raster rotation can be automatically compensated in an optimum state.

10 Claims, 7 Drawing Sheets

COLOR CRT DISPLAY APPARATUS

BACKGROUND OF THE INVENTION

1. Field of the Invention

The present invention relates to a color CRT display apparatus having a compensating coil for generating a magnetic field to cancel an external magnetic field which influences on the color CRT in the tube axis direction.

2. Description of the Related Art

A cathode ray tube (hereinafter referred to as a CRT) for displaying a color image is called as a Braun tube, which is used in a television set and so forth. The CRT has an electron gun from which electron beams are emitted. The electron beams are deflected by a magnetic field formed by a deflection yoke. The deflected beams are made to scan a display panel so as to light phosphor coated portions on the display panel, resulting in images on the display panel. Because of this construction, the images are easily influenced by an external magnetic field. If an external magnetic field such as the earth magnetism is given to the CRT, the position at which the electron beam collides with the display panel is changed so that a problem arises in that a correct image can not be obtained.

To prevent the influence by the external field, in a conventional color CRT display apparatus, the CRT is magnetically shielded by covering the CRT with a magnetic tube. It is, however, impossible to provide the magnetic shield on the portion of the display panel of the CRT because the display panel is to be seen from the external. Therefore, it is necessary to prevent the magnetic influence of the external magnetic field in the tube direction connecting the display panel of the CRT and the electron gun.

FIG. 1A is a cross-sectional view of a conventional color CRT display apparatus provided with a compensating coil around a panel disclosed in, for example, the Japanese Utility Model Publication (kokai) No. 61-33574). In the illustrated conventional example, the magnetic field for cancelling the external magnetic field in the tube direction of the CRT is automatically generated by using the compensating coil. In the figure, reference numeral 1 is the CRT including an electron gun 1*a* for emitting electron beams, a panel 1*b* adapted to be irradiated by the electron beams to display images, and a funnel part 1*c* provided between the electron gun 1*a* and the panel 1*b*.

Reference numeral 2 is a magnet detection clement for detecting the polarity or the strength of the external magnetic field in the tube direction connecting between the electron gun 1*a* and the panel 1*b* to convert it into an electric signal. Reference numeral 3 is a current supplying circuit for receiving the electric signal from the magnet detection element 2 to supply a current proportional to the detected strength of the external magnetic field and having a direction corresponding to the detected polarity. Reference symbol 4*a* is a compensating coil for generating a compensating magnetic field for cancelling the external magnetic field in the tube direction of the CRT 1 when the current is supplied from the current supplying circuit 3. In the example shown in FIG. 1A, the compensating coil 4*b* is wound around the panel 1*b* of the CRT 1. Reference numeral 5 is a deflection yoke for deflecting the electron beams emitted from the electron gun 1*a*. The deflection yoke 5 is wound around the separator flange 6.

FIG. 1B is a cross-sectional view showing a color CRT display apparatus in which a compensating coil 4*b* is wound around the deflect ion yoke 5.

Next, the operation of the color CRT display apparatus shown in FIG. 1A or 1B will be described. The magnet detection element 2 detects the polarity or the strength of the external magnetic field, and converts the detected polarity or strength into an electric signal which is then outputted to the current supplying circuit 3. In response to the electric signal, the current supplying circuit 3 supplies a current proportional to the strength of the external magnetic field and having a direction corresponding to the polarity to the compensating coil 4*a*. Thereby, the compensating coil 4*a* always and automatically generates a compensating magnetic field having the same strength as and opposite polarity to the external magnetic field in the tube axis direction so that the external magnetic field in the tube axis direction can be cancelled. Accordingly, even when the placing position of the CRT 1 is changed so that the polarity or the strength of the external magnetic field such as the earth magnetism is changed, the compensating magnetic field generated by the above-mentioned compensating coil 4*a* is automatically changed according to the change of the external magnetic field, so that the external magnetic field in the proximity of the CRT 1 along the tube axis direction can be cancelled.

The influence of the generation of the external magnetic field in the tube direction of the CRT 1 on the image display is that the electron beams are rotationally moved in the periphery of the image display of the CRT 1. The rotational movement is analyzed to be divided into a rotation of the raster as a whole and a rotation of purity. FIG. 2A and FIG. 2B are diagrams showing the influence on the image display when an external magnetic field is generated in the tube axis direction. In the figures, states of image displays are shown in which an external magnetic field is applied to the CRT 1 in the tube axis direction directing from the side of the panel 1*b* to the electron gun 1*a*.

FIG. 2A is a diagram showing a raster rotation. The raster rotation is a rotation of a raster as a whole which is caused by largely deflecting the electron beams as a whole in the rotating direction by the external magnetic field. FIG. 2B is a diagram showing a purity rotation. The purity rotation is, as illustrated in the figure, the rotational movement (here, it is a rotation in the clockwise direction) of the electron beams 8 which have passed through a not-shown shadow mask with respect to fluorescent parts 7 by which the electron beams are erroneously landed on portions illustrated by dash curves in the figure. By this purity rotation, the electron beams 8 collide with only a part illustrated by slash lines of the fluorescent parts 7.

The functions of the compensating magnetic field generated by the compensating coil 4*a* or 4*b* shown in FIG. 1A or 1B on the image display differ depending on the wound position of the compensating coil 4*a* or 4*b*. When the compensating coil 4*a* is wound in the proximity around the panel 1*b* as shown in FIG. 1A, for example, the functions of both the raster rotation shown in FIG. 2A and the purity rotation shown in FIG. 2B are generated, but the function of the purity rotation is generated notably in comparison with the function of the raster rotation. By contrast, when the compensating coil 4*b* is wound in the proximity around the deflection yoke 5, the function of the raster rotation shown in FIG. 2A is generated, but the function of the purity rotation shown in FIG. 2B is scarcely generated. The above-mentioned difference of the functions has been acknowledged by experiments.

Since the conventional color CRT display apparatus is constructed as described above, as shown in FIG. 1A, only the single compensating coil 4*a* wound in the proximity around the panel 1*b* of the CRT 1 is used to compensate the external magnetic field in the tube direction of the CRT 1. The compensating coil 4*a* wound at this position generates, as mentioned above, the magnetic field for generating the function of the purity rotation notably rather than the function of the raster rotation. Therefore, only one can do is to obtain the best adjustment by selecting either the raster rotation or the purity rotation to be a target, or to obtain a compromise compensation of both. According to this conventional compensation, there is a problem in that a high accuracy compensation corresponding to a high resolution of recent CRTs can not be achieved.

SUMMARY OF THE INVENTION

In view of the foregoing, it is an object of the present invention to provide a color CRT display apparatus which can simultaneously compensate both of the raster rotation and the purity rotation generated by an external magnetic field influencing on a CRT in the tube axis direction to be the optimum state.

According to the first aspect of the present invention, for achieving the above object, there is provided a color CRT display apparatus comprising signal outputting means for outputting a signal, indicating an amount and a direction thereof, to be used to compensate an external magnetic field in a tube direction connecting an electron gun with a display panel, a current supplying circuit for supplying a current proportional to the amount of the signal outputted from the signal outputting means and flowing in a direction corresponding to the direction of the signal, and a compensating coil for generating a compensating magnetic field in response to the current from the current supplying circuit, the compensating coil being wound around a funnel portion between the display panel and the deflection yoke and at a place where a purity rotation and a raster rotation by the external magnetic field in the tube direction are simultaneously compensated.

As stated above, in the color CRT display apparatus according to the first aspect of the present invention, the signal outputting means outputs the amount and the direction of the signal used to compensate the external magnetic field, thereby an automatic compensation in the compensating coil becomes possible. In addition, by winding the compensating coil around the funnel portion between the display panel and the deflection yoke and at the place where the purity rotation and the raster rotation by the external magnetic field in the tube direction are simultaneously compensated, the compensating coil can generate a compensating magnetic field which can simultaneously compensate most suitably the influences, on the image display, of the purity rotation and the raster rotation due to the external magnetic field in the tube direction.

According to the second aspect of the present invention, the signal output ting means is a magnet detection element for detecting a polarity and an amount of the external magnetic field in the tube direction connecting the electron gun with the display panel, and the current supplying circuit is a first current supplying circuit for supplying, in response to the detected signal from the magnet detection element, a current proportional to the strength of the external magnetic Field and flowing in a direction corresponding to the direction of the polarity.

As stated above, in the color CRT display apparatus according to the second aspect of the present invention, the magnet detection element detects the polarity and the strength of the external magnetic field in the tube direction of the color CRT and outputs them to the first current supplying circuit, thereby an automatic compensation in the compensating coil becomes possible.

According to the third aspect of the present invention, the signal outputting means is an externally controllable circuit for outputting an externally controllable signal indicating art amount and a direction, and said current supplying circuit is a second current supplying circuit for supplying, in response to the signal outputted from the externally controllable circuit, a current proportional to the strength of the signal and flowing in a direction corresponding to the direction of the signal.

As stated above, in the color CRT display apparatus according to the third aspect of the present invention, the externally controllable circuit outputs, to the second current supplying circuit, the signal indicating the amount and the direction which are controllable from the external world, thereby a manual compensation of the compensating coil becomes possible and the magnet detection element becomes unnecessary.

According to the fourth aspect of the present invention, the color CRT display apparatus comprises a first coil-winding frame For accommodating the compensating coil and having a projection fixed to the funnel portion.

As stated above, in the color CRT display apparatus according to the fourth aspect of the present invention, the First coil-winding frame for accommodating the compensating coil is fixed to the funnel portion by the projection, thereby the winding-frame fixing member and so forth are not necessary so that the structure of the apparatus is simplified. In addition, since the first coil-winding frame is directly fixed to the funnel portion, it becomes an effective mounting means when there is no space for mounting the compensating coil on the deflection yoke and the housing.

According to the fifth aspect of the present invention, the color CRT display apparatus comprises a second coil-winding frame for accommodating the compensating coil, and a first winding-frame fixing member for connecting the second coil-winding frame and the deflection yoke and for fixing the second coil-winding frame to the funnel portion.

As stated above, according to the fifth aspect of the present invention, the second coil-winding frame for accommodating the compensating coil is fixed to the funnel portion by the first winding-frame fixing member for connecting the second coil-winding frame and the deflection yoke, thereby in the manufacturing process, the process for directly fixing the second coil-winding frame to the funnel portion becomes unnecessary so that the manufacturing process is simplified. In addition, by changing the length of the first winding-frame fixing member, it becomes possible to use a plurality of types of shapes of the second coil-winding frames.

According to the sixth aspect of the present invention, the color CRT display apparatus comprises a second coil-winding frame for accommodating the compensating coil, and a second winding-frame fixing member for connecting the second coil-winding frame to a housing of the color CRT.

As stated above, according to the sixth aspect of the present invention, the second coil-winding frame for accommodating the compensating coil is fixed to the funnel portion by the second winding-frame fixing member for connecting the second-coil winding frame to the housing, thereby this becomes effective means as mounting means when there is no space for mounting the compensating coil around the color CRT.

The above and further objects and novel features of the invention will more fully appear from the following detailed description when the same is read in connection with the accompanying drawings, It is to be expressly understood, however, that the drawings are for the purpose of illustration only and are not intended as a definition of the limits of the invention.

DESCRIPTION OF THE PREFERRED EMBODIMENTS

Embodiment 1

Figure 1A:
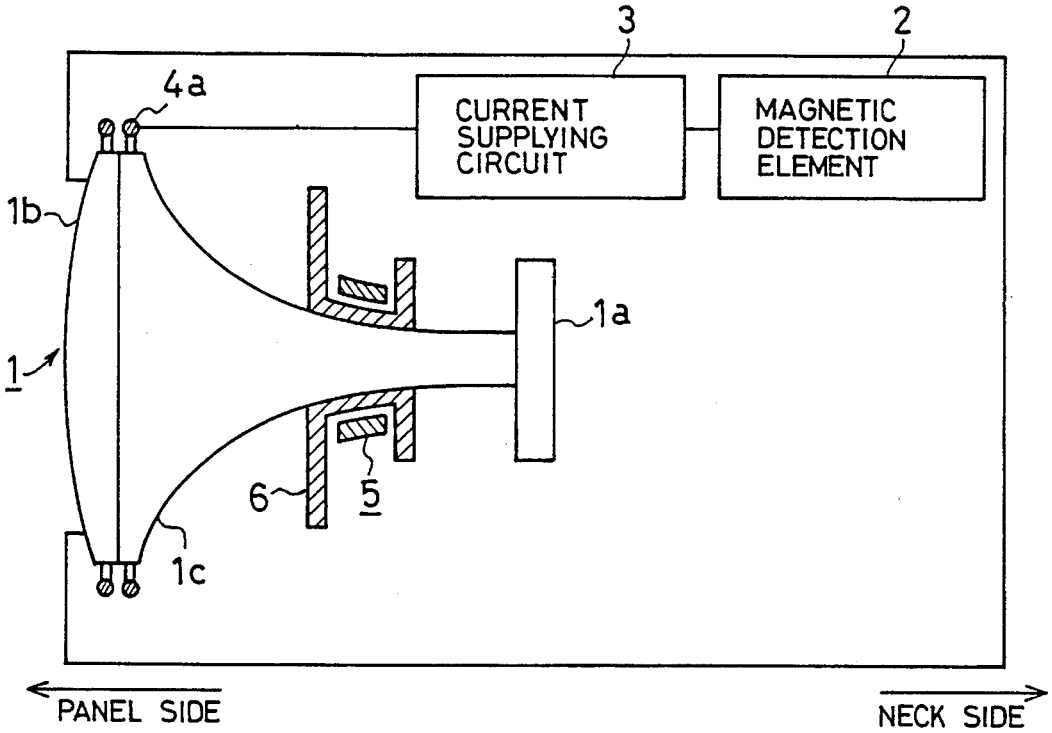
FIG. 1A (PRIOR ART)
FIG. 1A and FIG. 1B are cross-sectional views showing conventional color CRT display apparatuses.
Figure 1B:
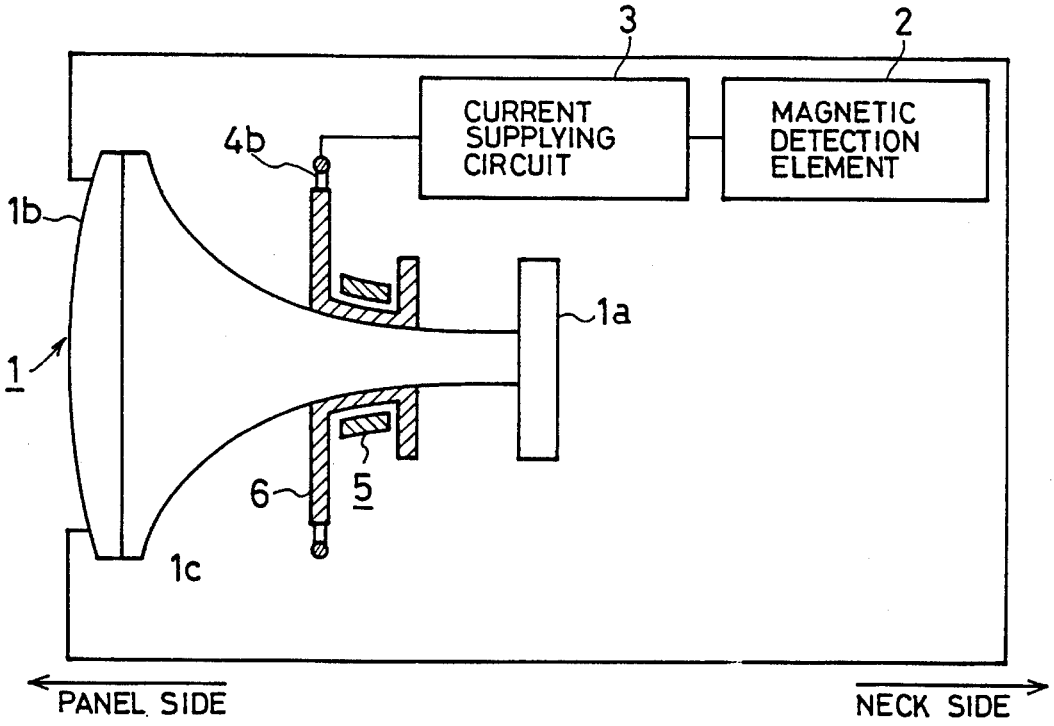
FIG. 1B (PRIOR ART)
Figure 2A:
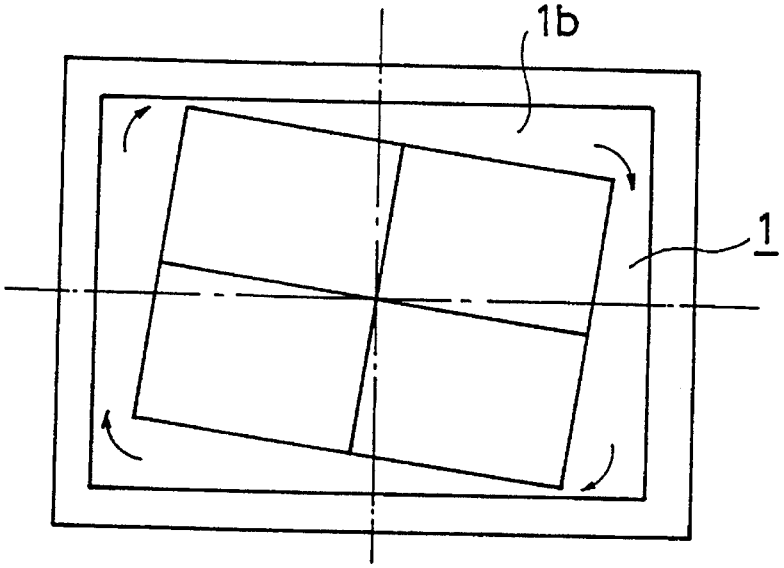
FIG.2A (PRIOR ART)
FIG. 2A and FIG. 2B are explanatory diagrams showing influences of an external magnetic field in the tube axis direction of the CRT on the image display of the conventional color CRT display apparatuses shown in FIGS. 1A and 1B.
Figure 2B:
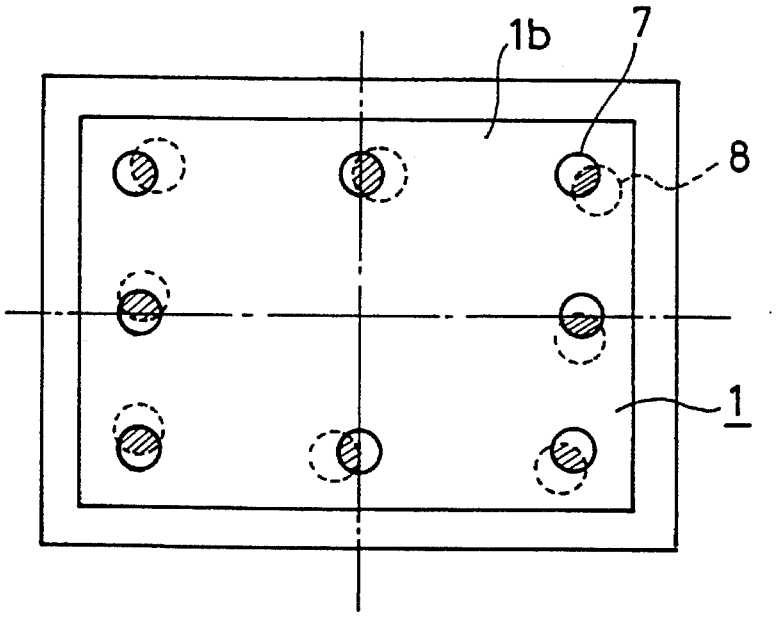
FIG.2B (PRIOR ART)
Figure 3:
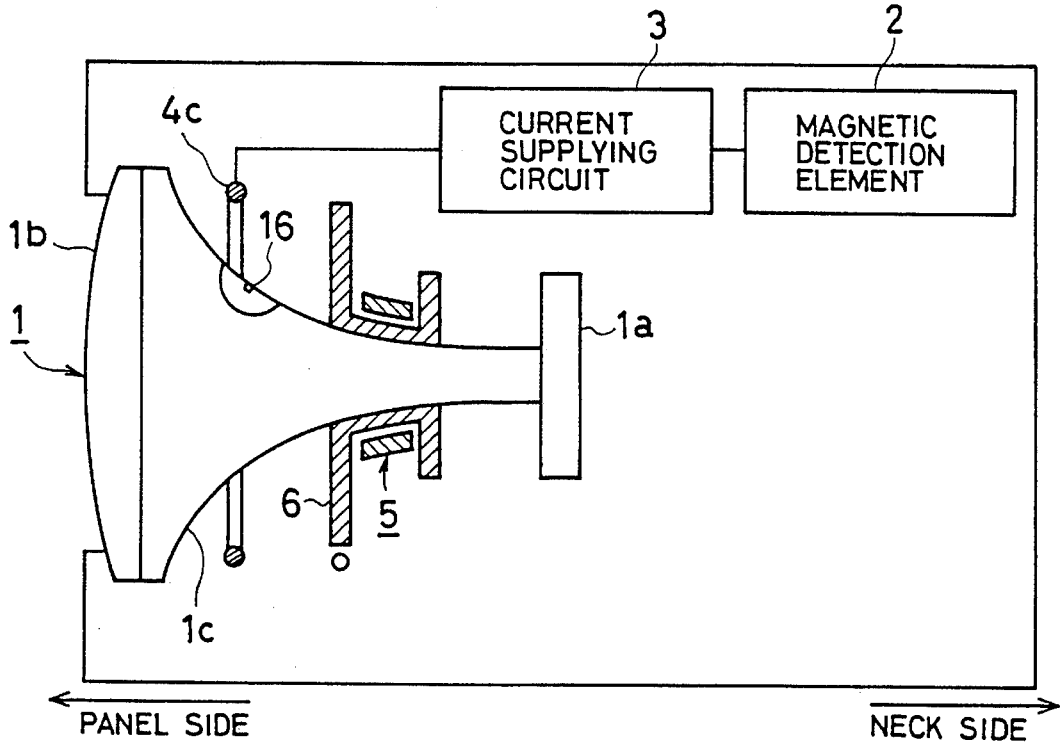
FIG. 3 is a cross-sectional view showing a color CRT display apparatus according to an embodiment of the first and second aspects of the present invention.

In the following, an embodiment of the present invention will be described with reference to the drawings. FIG. 3 is a cross-sectional view showing a color CRT display apparatus according to an embodiment of the first and third of the present invention. In the figure, reference numeral 1 is a CRT (color cathode ray tube) including an electron gun 1*a*, a panel 1*b*, and a funnel portion 1*c*. Reference numeral 2 is a magnet detection element (signal outputting means) for detecting a polarity and a strength of an external magnetic field in the tube axis direction connecting between the electron gun 1*a* and the panel 1*b*, 3 is a current supplying circuit (first current supplying circuit) for supplying, in response to the detected signal from the magnet detection element 2, a current proportional to the strength of the external magnetic field and flowing in a direction corresponding to the polarity of the external magnetic field, 4*c* is a compensating coil for generating a compensating magnetic field corresponding to the current from the current supplying circuit 3. The compensating coil 4*c* is wound around a funnel portion between the display panel 1*b* of the CRT 1 and the deflection yoke 5 and at a place where a purity rotation and a raster rotation by the external magnetic field in the tube direction are simultaneously compensated. Reference numeral 6 is a separator flange around which the deflection yoke 5 is wound, 16 is an anode button mounted on the funnel portion 1*c* and at a nearly central portion between the panel 1*b* and the deflection yoke 5. By operating the anode button 16, a high voltage (generally 23 KV to 28 KV) is applied to the CRT 1.

The place to mount the compensating coil 4*c* is determined as follows.

When the compensating coil 4*c* is wound in the proximity around the panel 1*b* of the CRT 1, the function of the purity rotation is mainly generated and the function of the raster rotation is slightly generated, as described before. Namely, in this case, the compensating coil 4*c* mainly has the compensating function for the purity rotation, and slightly has the compensating function for the raster rotation. By contrast, when the compensating coil 4*c* is in the proximity around the deflection yoke 5 or the CRT 1, the function of the raster rotation is mainly generated. Namely, in this case, the compensating coil 4*c* mainly has the compensating function for the raster rotation. In view of the above-mentioned two cases, according to an embodiment of the present invention, the mounting place of the compensating coil 4*c* is determined to be a place of the funnel portion 1*c* between the panel 1*b* and the deflection yoke 5 in such a way that both of the purity rotation and the raster rotation are compensated simultaneously and to be optimum. The optimum place of the compensating coil 4*e* depends on the size of the panel 1*b* to some extent, however, according to experiments performed by the inventors of the present invention, it has been found that, for a CRT with a display panel of 17 inches, the place of the anode button is optimum, and for a CRT with a display panel of 21 inches, a place at a distance of 50 mm from the anode button 16 toward the panel 1*b* is optimum for completely compensate both of the purity rotation and the raster rotation. Thus, the compensating coil 4*e*, the mounting position of which is determined as described above, can automatically, simultaneously, and most suitably compensate both of the purity rotation and the raster rotation due to the external magnetic field in the tube direction of the CRT 1.

Next, the operation of the color CRT display apparatus shown in FIG. 3 will be described. First, the polarity and the strength, detected by the magnet detection element 1, of the external magnetic field in the tube direction of the CRT 1 are converted into electric signals which are then outputted to the current supplying circuit 3. In response to the electric signals from the magnet detection element 2, the current supplying circuit 3 supplies a current proportional to the strength of the magnetic field and flowing in a direction corresponding to the polarity of the external magnetic field to the compensating coil 4*c*. Then, the compensating coil 4*c* generates a compensating magnetic field for compensating automatically, simultaneously and most suitably both of the purity rotation and the raster rotation caused by the external magnetic field in the tube direction of the CRT 1. Accordingly, the color CRT display apparatus according to this embodiment can automatically, simultaneously and most suitably compensate the purity rotation and the raster rotation caused by the external magnetic field in the tube direction of the CRT 1.

Embodiment 2

Figure 4:
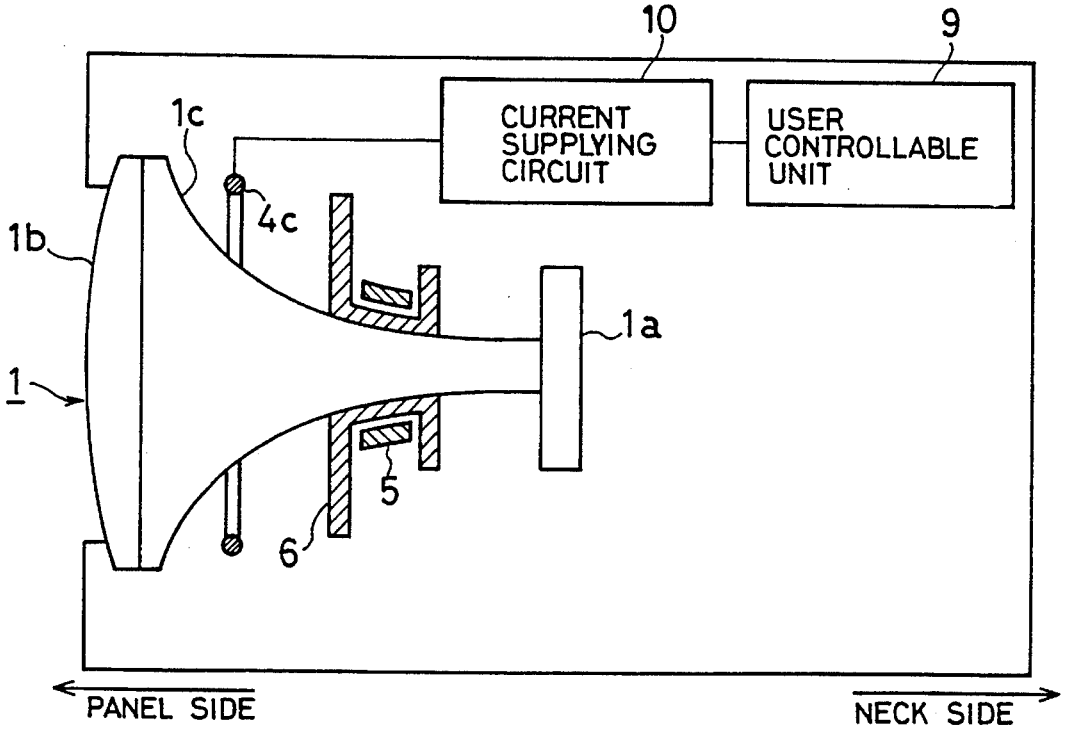
FIG. 4 is a cross-sectional view showing a color CRT display apparatus according to an embodiment of the first and third aspects of the present invention.

FIG. 4 is a cross-sectional view showing a color CRT display apparatus according to an embodiment of the first and third aspects of the present invention. In the figure, reference numeral 9 is signal outputting means. In the illustrated example, the signal outputting means is a user controllable unit (externally controllable circuit) such as a variable resistor and so forth which can be operated by means of a volume control knob, a push button, and so forth opened to be used by users. Reference numeral 10 is a current supplying circuit (second current supplying circuit) for supplying a current corresponding to the signal from the user controllable unit 9 to the compensating coil 4*c*. The other elements are the same as those shown in FIG. 3, and therefore, the description thereof is omitted here.

Next, the operation of the color CRT display apparatus shown in FIG. 4 will be described. First, a user operates the volume control knob, the push button and so forth to output an electric signal indicating an amount and a direction thereof to the current supplying circuit 10. The current supplying circuit 10 supplies, in response to the electric signal from the user controllable unit 9, a current proportional to the amount of the electric signal and flowing in a direction corresponding to the direction of the electric signal to the compensating coil 4*c*. As a result, the compensation of the purity rotation and the raster rotation in the compensating coil 4*c* can be effected manually, and the magnet detection element 2 in the embodiment 1 becomes unnecessary, so that the cost of the apparatus can be reduced. In addition, by winding the compensating coil 4*c* around the funnel portion 1*c* between the display panel 1*b* and the deflection yoke 5 and at the place where the purity rotation and the raster rotation by the external magnetic field in the tube direction are simultaneously compensated, the compensating coil 4*c* can generate a compensating magnetic field which can simultaneously compensate most suitably the influences, on the image display, of the purity rotation and the raster rotation due to the external magnetic field in the tube direction.

Embodiment 3

Figure 5B:
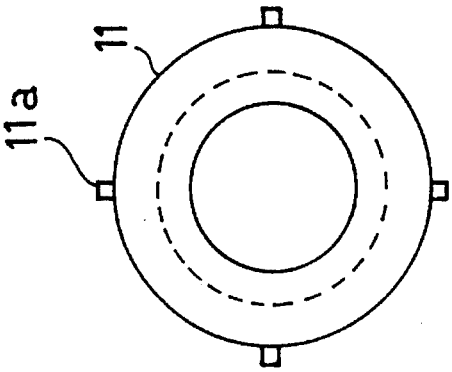
FIG. 5A and FIG. 5B are cross-sectional views showing a color CRT display apparatus according to an embodiment of the fourth aspect of the present invention.
Figure 5A:
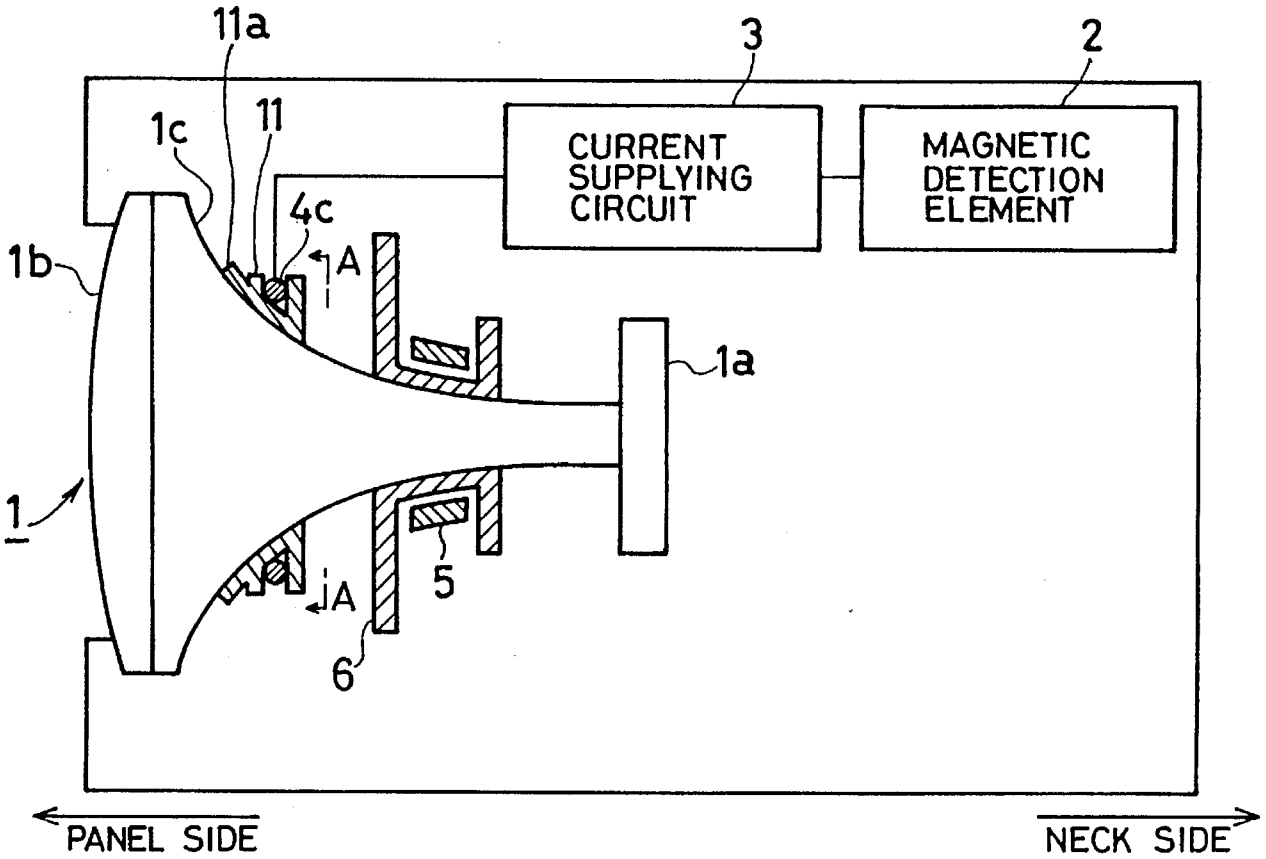

FIG. 5A is a cross-sectional view of a color CRT display apparatus according to an embodiment of the fourth aspect of the present invention, and FIG. 5B is a cross-sectional view when a cross section of the CRT 1 shown in FIG. 5A is viewed in the direction indicated by arrows. In the figure, 11 is a coil winding frame (first coil winding frame) for accommodating the compensating coil 4*c* and having a projection 11*a* fixed to the funnel portion 1*c*.

Thus, by fixing the first coil-winding frame 11 for accommodating the compensating coil 4*c* to the funnel portion 1*c* by means or the projection 11*a*, an attachment member such as the winding-frame fixing member and so forth are not necessary so that compensating coil 4*c* can be fixed by a simple structure. In addition, since the coil-winding frame 11 is directly fixed to the funnel portion, it becomes an effective mounting means when there is no space for mounting the compensating coil 4*c* on the deflection yoke 5 and the housing.

Figure 6:
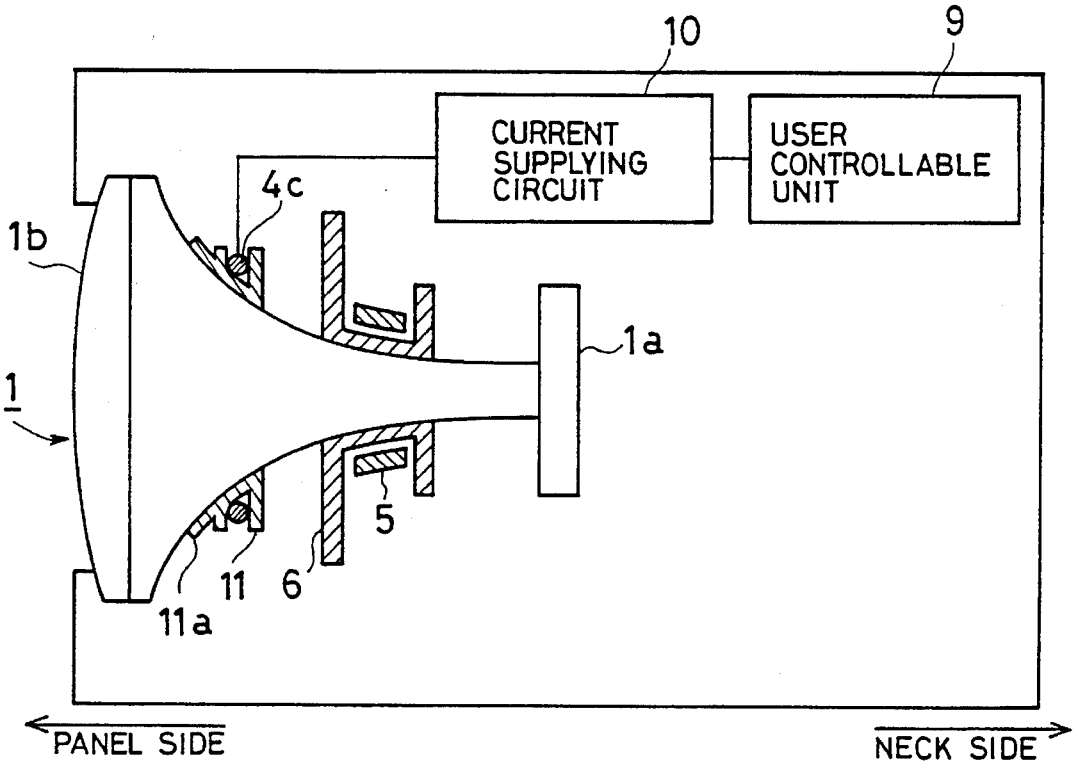
FIG. 6 is a cross-sectional view showing a color CRT display apparatus according to another embodiment of the fourth aspect or the present invention.

FIG. 6 is a cross-sectional view of a color CRT display apparatus when the coil winding frame 11 is applied to the embodiment 2. The apparatus shown in FIG. 6 has the same effect as the apparatus shown in FIG. 5A.

Embodiment 4

Figure 7:
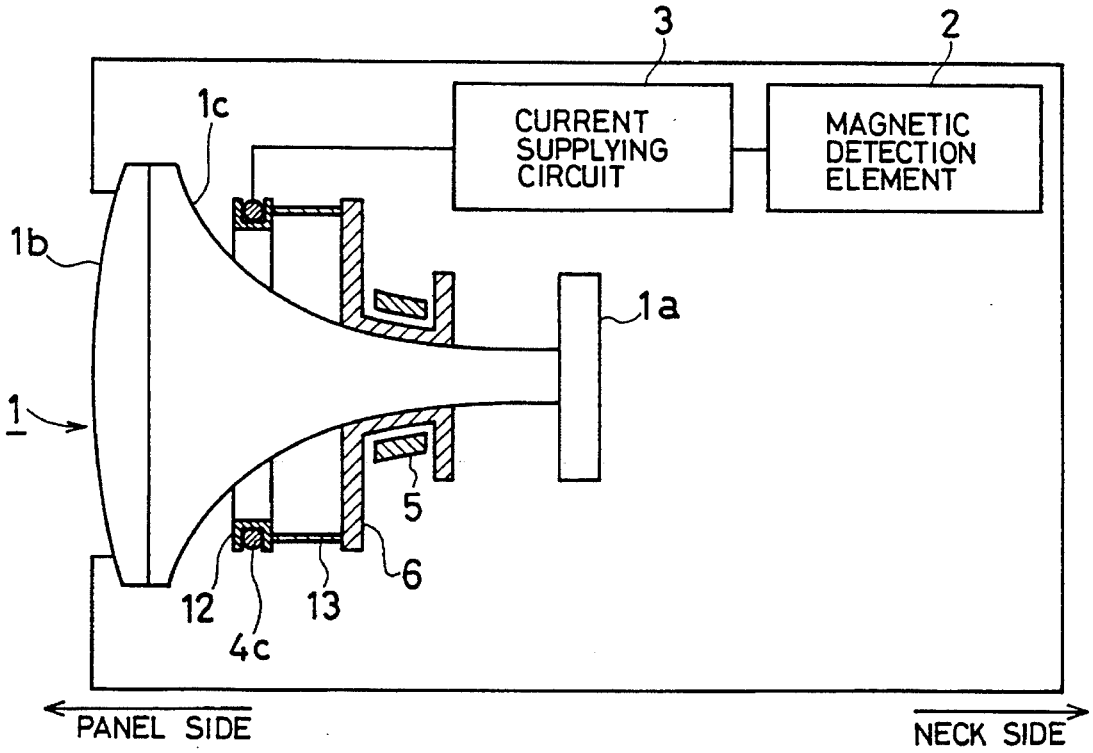
FIG. 7 is a cross-sectional view showing a color CRT display apparatus according to an embodiment of the fifth aspect of the present invention.

FIG. 7 is a cross-sectional view showing a color CRT display apparatus according to an embodiment of the fifth aspect of the present invention. In the figure, reference numeral 12 is a coil winding frame (second coil winding frame) for accommodating the compensating coil 4*c*, and 13 is an attachment member (first winding frame fixing member) for fixing the coil winding frame 12 for connecting the coil winding frame 12 with a separator flange 6 of the deflection yoke 5, and for fixing he coil winding frame 12 to the funnel portion 1*c*.

Thus, the coil-winding frame 12 for accommodating the compensating coil 4*c* is fixed to the funnel portion 1*c* by the attachment member 13 for connecting the coil-winding frame 12 and the deflection yoke 5, thereby in the manufacturing process, the process for directly fixing the coil-winding frame 12 to the funnel portion 1*c* becomes unnecessary so that the manufacturing process is simplified. In addition, by changing the length of the attachment member, there is an effect in that it becomes possible to use a plurality of types of shapes of the second coil winding frames 12.

Figure 8:
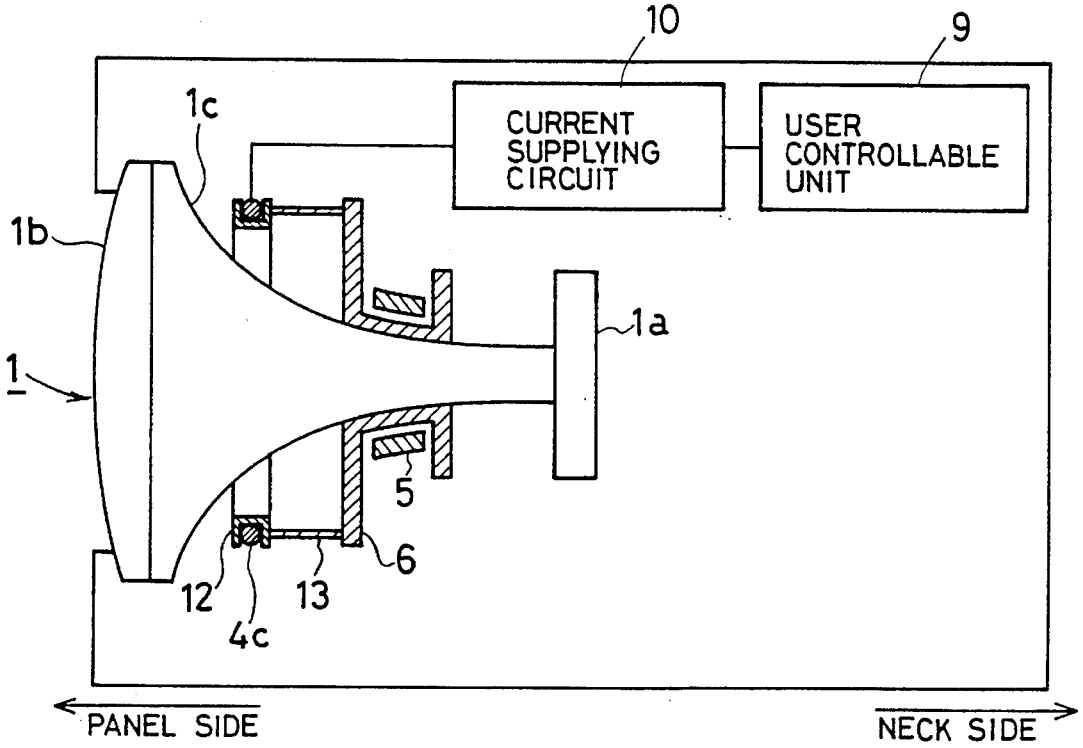
FIG. 8 is a cross-sectional view showing a color CRT display apparatus according to another embodiment of the fifth aspect of the present invention.

FIG. 8 is a cross-sectional view of a color CRT display apparatus when the coil winding frame 12 is applied to the embodiment 2. The apparatus shown in FIG. 8 also has the same effect as the apparatus shown in FIG. 7.

Embodiment 5

Figure 9:
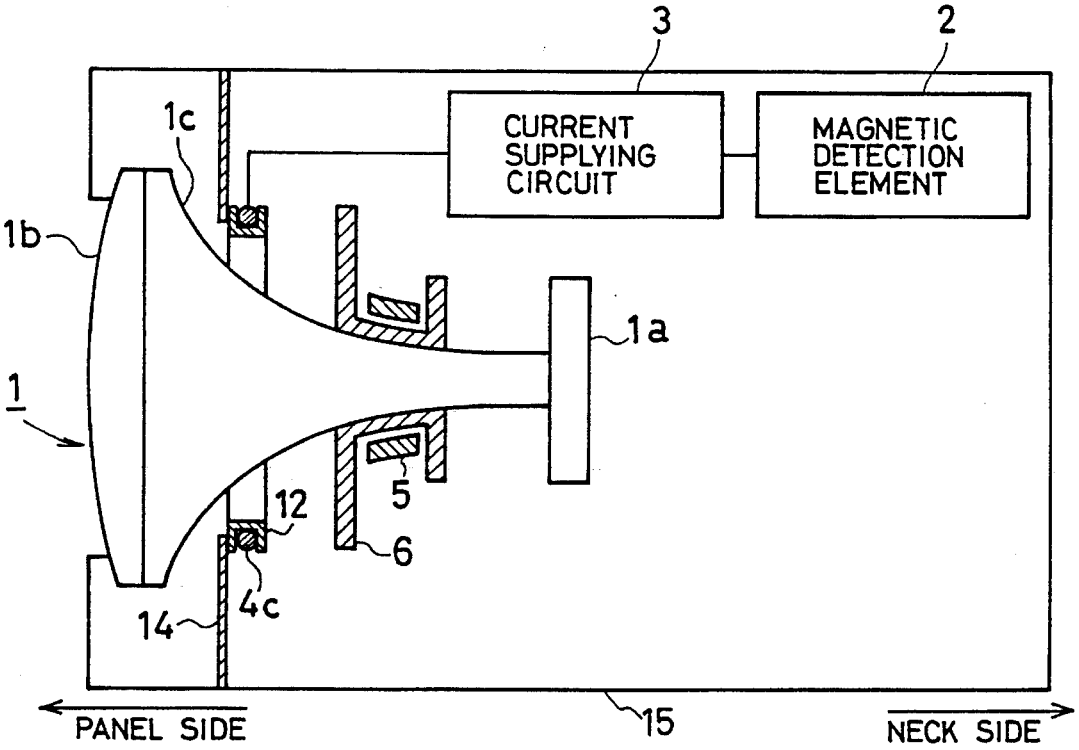
FIG. 9 is a cross-sectional view showing a color CRT display apparatus according to an embodiment of the sixth aspect of the present invention.
Figure 10:
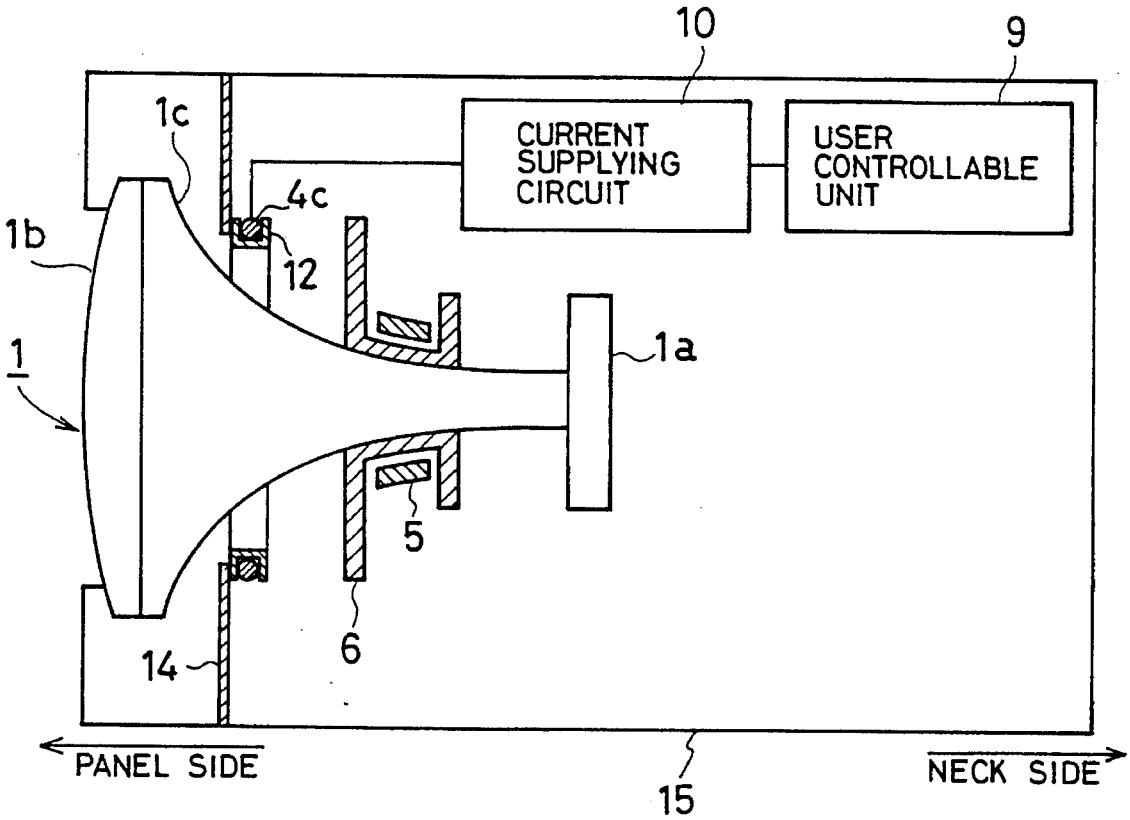
FIG. 10 is a cross-sectional view showing a color CRT display apparatus according to another embodiment of the sixth aspect of the present invention.

FIG. 9 is a cross-sectional view showing a color CRT display apparatus according to an embodiment of the sixth aspect of the present invention. In the figure, reference numeral 14 is an attachment member (second winding-frame fixing member) for connecting the coil-winding frame 12 to a housing 15 of the color CRT.

Thus, the coil-winding frame for accommodating the compensating coil 4*c* is fixed to the funnel portion 1*c* by the attachment member 14 for connecting the coil-winding frame 12 to the housing 15, thereby there is an effect in that this becomes effective means as mounting means when there is no space for mounting the compensating coil around the color CRT.

The present invention is not restricted to the above-described embodiments, but various modifications are possible without departing from the spirit of the present invention.

From the foregoing description, it will be apparent that, according to the first aspect of the present invention, the signal outputting means outputs the amount and the direction of the signal used to compensate the external magnetic field, thereby an automatic compensation in the compensating coil becomes possible. In addition, by winding the compensating coil around the funnel portion between the display panel and the deflection yoke and at the place where the purity rotation and the raster rotation by the external magnetic field in the tube direction are simultaneously compensated, there is an effect in that the compensating coil can generate a compensating magnetic field which can simultaneously compensate most suitably the influences, on the image display, of the purity rotation and the raster rotation due to the external magnetic field in the tube direction.

According to the second aspect of the present invention, the polarity and the strength or the external magnetic field in the tube direction of the color CRT are detected by the magnet detection element, and a current corresponding to the strength and polarity of the external magnetic field is supplied to the compensating coil wound around the funnel portion between the display panel and the deflection yoke and at the place where the purity rotation and the raster rotation by the external magnetic field in the tube direction are simultaneously compensated, an automatic compensation can be effected in the compensating coil.

According to the third aspect of the present invention, the externally controllable circuit outputs the signal indicating the amount and the direction which are controllable from the external world, and a current proportional to the amount of the signal and having a direction corresponding to the direction of the signal is supplied to the compensating circuit, thereby there is an effect in that a manual compensation in the compensating coil becomes possible by means of the externally controllable circuit.

According to the fourth aspect of the present invention, the color CRT display apparatus comprises a first coil-winding frame for accommodating the compensating coil and having a projection fixed to the funnel portion, thereby the first coil-winding frame is fixed to the funnel portion by the projection, so that the winding-frame fixing member and so forth are not necessary and the structure of the apparatus is simplified. In addition, since the first coil-winding frame is directly fixed to the funnel portion, there is an effect in that, even when there is no space for mounting the compensating coil on the deflection yoke and the housing, the first coil-winding frame can be fixed to the funnel portion.

According to the fifth aspect of the present invention, the color CRT display apparatus comprises a second coil-winding frame for accommodating the compensating coil, and a first winding-frame fixing member for connecting the second coil-winding frame with the deflection yoke and for fixing the second coil-winding frame to the funnel portion, thereby the second coil-winding frame is fixed to the runnel portion by the first winding-frame fixing member for connecting the second coil-winding frame with the deflection yoke, so that, in the manufacturing process, the process for directly fixing the second coil-winding frame to the funnel portion becomes unnecessary, resulting in a simplification of the manufacturing process. In addition, by changing the length or the first winding-frame fixing member, there is an effect in that it becomes possible to use a plurality or types of shapes of the second coil-winding frames.

According to the sixth aspect of the present invention, the color CRT display apparatus comprises a second coil-winding frame for accommodating the compensating coil, and a second winding-frame fixing member for connecting the second coil-winding frame to a housing or the color CRT, thereby the second coil-winding frame can be fixed to the funnel portion by the second winding-frame fixing member for connecting the second-coil winding frame to the housing, so that there is an effect in that, even when there is no space for mounting the compensating coil around the color CRT, the second-coil winding frame can be fixed to the funnel portion.

What is claimed is:

1. A color CRT display apparatus comprising:

a color CRT having an electron gun, a deflection yoke, and a display panel, for displaying, on said display panel, an image created by electron beams emitted from said electron gun and deflected by said deflection yoke;

signal outputting means for outputting a signal to be used to compensate an external magnetic field in a tube axis direction, said signal having an amount and a direction;

a current supplying circuit for supplying a current proportional to the amount of said signal outputted from said signal outputting means and flowing in a direction corresponding to the direction of said signal; and a compensating coil, disposed in a plane substantially perpendicular to said tube axis-direction, for generating a compensating magnetic field in response to the current from said current supplying circuit, said compensating coil being wound around a tunnel portion of the color CRT between said display panel and said deflection yoke at a position along said tube axis direction substantially closer to said display, panel than a first location at which a compensating magnetic field compensates primarily for raster rotation and substantially closer to said deflection yoke than a second location at which a compensating magnetic field compensates primarily for purity rotation.

2. A color CRT display apparatus as claimed in claim 1, wherein said signal outputting means is a magnet detection element for detecting a polarity and a strength of the external magnetic field in the tube axis direction, and said current supplying circuit is a first current supplying circuit for supplying, in response to the detection by said magnet detection element, a current proportional to the strength of said external magnetic field and flowing in the direction corresponding to the polarity.

3. A color CRT display apparatus as claimed in claim 2 further comprising a first coil-winding frame for housing said compensating coil and having a projection to be fixed to said funnel portion.

4. A color CRT display apparatus as claimed in claim 2 further comprising:

a second coil-winding frame for housing said compensating coil; and a first winding-frame fixing member for connecting said second coil-winding frame with said deflection yoke and for fixing said second coil-winding frame to said funnel portion.

5. A color CRT display apparatus as claimed in claim 2 further comprising:

a second coil-winding frame for housing said compensating coil; and a second winding-frame fixing member for connecting said second coil-winding frame to a housing of said color CRT, and for fixing said second coil winding frame to said funnel portion.

6. A color CRT display apparatus as claimed in claim 1, wherein said signal outputting means is a user controllable circuit for outputting a signal indicating an amount and a direction, said signal being controllable by a user, and said current supplying circuit is a second current supplying circuit for supplying, in response the the signal outputted from said user controllable circuit, a current proportional to the strength of said signal and flowing in the direction corresponding to the direction of said signal.

7. A color CRT display apparatus as claimed in claim 6 further comprising a first coil-winding frame for housing said compensating coil and being fixed to said funnel portion.

8. A color CRT display apparatus as claimed in claim 6 further comprising:

a second coil-winding frame for housing said compensating coil; and a first winding-frame fixing member for connecting said second coil-winding frame and said deflection yoke and for fixing said second coil-winding frame said funnel portion.

9. A color CRT display apparatus as claimed in claim 6 further comprising:

a second coil-winding frame for housing said compensating coil; and a second winding-frame fixing member for connecting said second coil-winding frame to a housing of said color CRT.

10. A CRT display apparatus comprising:

a CRT having an electron gun, a deflection yoke, and a display panel, for displaying an image created by electron beams emitted from the electron gun and deflected by the deflection yoke;

means for supplying a current to be used to compensate an external magnetic field incident on the CRT, the current having a direction and a magnitude based on the external magnetic field; and a compensating coil, disposed in a plane substantially perpendicular to said tube axis direction, for generating a compensating magnetic field in response to the current supplied by the current supplying means, the compensating coil being wound around a funnel portion of the CRT between the display panel and the deflection yoke at a position along said tube axis direction substantially closer to said display panel than a first location at which a compensating magnetic field compensates primarily for raster rotation and substantially closer to said deflection yoke than a second location at which a compensating magnetic field compensates primarily for purity rotation.

* * * * *